US008173961B2

(12) United States Patent
Iwamoto et al.

(10) Patent No.: US 8,173,961 B2
(45) Date of Patent: May 8, 2012

(54) ION TRAP MASS SPECTROMETER

(75) Inventors: Shinichi Iwamoto, Kyoto (JP); Kei Kodera, Kyoto (JP); Sadanori Sekiya, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 125 days.

(21) Appl. No.: 12/595,024

(22) PCT Filed: Mar. 28, 2008

(86) PCT No.: PCT/JP2008/000812

§ 371 (c)(1),
(2), (4) Date: Nov. 11, 2009

(87) PCT Pub. No.: WO2008/126383

PCT Pub. Date: Oct. 23, 2008

(65) Prior Publication Data

US 2010/0116982 A1 May 13, 2010

(30) Foreign Application Priority Data

Apr. 9, 2007 (JP) ..... 2007-101277

(51) Int. Cl.
*H01J 49/42* (2006.01)
*H01J 49/34* (2006.01)

(52) U.S. Cl. ..... 250/292; 250/288; 250/282; 250/286

(58) Field of Classification Search ..... 250/292, 250/282, 281, 286, 288
See application file for complete search history.

(56) References Cited

U.S. PATENT DOCUMENTS

| | | | | |
|---|---|---|---|---|
| 5,397,894 | A | 3/1995 | Wells et al. | |
| 6,900,433 | B2 | 5/2005 | Ding | |
| 2002/0190206 | A1 | 12/2002 | Taniguchi et al. | |
| 2009/0032698 | A1 * | 2/2009 | Furuhashi et al. | 250/282 |
| 2010/0065740 | A1 * | 3/2010 | Iwamoto et al. | 250/288 |

FOREIGN PATENT DOCUMENTS

JP 04-138650 A 5/1992

(Continued)

OTHER PUBLICATIONS

Osamu Furuhashi et al., "Development of Digital Ion Trap Mass Spectrometer", Shimadzu Review, Mar. 31, 2006, pp. 141-151, vol. 62, No. 3-4.

Written Opinion of ISA dated May 13, 2008, issued in corresponding International Application No. PCT/JP2008/000812.

(Continued)

*Primary Examiner* — Nikita Wells

(74) *Attorney, Agent, or Firm* — Sughrue Mion, PLLC

(57) ABSTRACT

While applying a square wave voltage to the ion electrode (21) so that ions already captured in the ion trap (20) do not disperse, the timing of irradiating a laser light for ion generation is controlled in such a manner that ions reach the ion inlet (25) at a predetermined timing of a cycle of the voltage. In the case of a positive ion (cation) for example, the timing of laser light irradiation is adjusted in such a manner that the target ions reach the ion inlet (25) in the low level period of a cycle of the square wave voltage. By injecting ions in addition to the ions already captured in the ion trap (20) in this manner, the amount of ions can be increased, and by performing a mass separation and detection after that, the signal intensity in one mass analysis can be increased. Accordingly, by decreasing the number of repetitions of the mass analysis for summing up mass profiles, the measuring time can be shortened.

18 Claims, 9 Drawing Sheets

FOREIGN PATENT DOCUMENTS

| | | | |
|---|---|---|---|
| JP | 07-085836 | A | 3/1995 |
| JP | 2001-307675 | A | 11/2001 |
| JP | 3386048 | B2 | 6/2002 |
| JP | 2002-373617 | A | 12/2002 |
| JP | 2003-016991 | A | 1/2003 |
| WO | 95/19041 | A1 | 7/1995 |

OTHER PUBLICATIONS

Weil, C., et al., "Multiplarticle Simulation of Ion Injection into the Quadrupole Ion Trap Under the Influence of Helium Buffer Gas Using Short Injection Times and DC Pulse Potentials," Rapid Communications in Mass Spectrometry, vol. 10, 742-750 (1996).

* cited by examiner (a) IONS EXISTING WHEN t=0μs (b) IONS EXISTING WHEN t=250μs IN THE CASE WHERE A SQUARE WAVE VOLTAGE IS APPLIED TO THE RING ELECTRODE AT 13μs AFTER THE ION GENERATION (c) IONS EXISTING WHEN t=250μs IN THE CASE WHERE A SQUARE WAVE VOLTAGE HAS BEEN APPLIED TO THE RING ELECTRODE BEFORE THE ION INJECTION (a) IONS EXISTING WHEN t=0μs (b) IONS EXISTING WHEN t=250μs WITH A DUTY RATIO OF 0.5

(c) IONS EXISTING WHEN t=250μs WITH A DUTY RATIO OF 0.25

(a) NO ADDITIONAL ION INJECTION (b) ONE ADDITIONAL ION INJECTION (c) TWO ADDITIONAL ION INJECTIONS

ION TRAP MASS SPECTROMETER

TECHNICAL FIELD

The present invention pertains to an ion trap mass spectrometer having an ion trap for trapping ions by an electric field.

BACKGROUND ART

One conventionally known type of mass spectrometer uses an ion trap for capturing (or trapping) ions by an electric field. A typical ion trap is a so-called three-dimensional quadrupole ion trap, which has a substantially-circular ring electrode and a pair of end cap electrodes placed in such a manner as to face each other across the ring electrode. In such an ion trap, conventionally, a sinusoidal radio-frequency voltage is applied to the ring electrode to form a capture electric field, and ions are oscillated and trapped by this capture electric field. In recent years, the digital ion trap (DIT) for trapping ions by applying a square wave wave voltage in place of a sinusoidal voltage has been developed (refer to Non-Patent Document 1 and other documents).

In the case where the sample is biological, a laser desorption ionization (LDI) source such as the matrix assisted laser desorption ionization (MALDI) source is often used as an ion source for generating ions to be trapped in the ion trap as previously described.

In an ion trap mass spectrometer in which the MALDI and the DIT are combined, a flash (or a pulse) of laser light is delivered to a sample, and ions generated thereby from the sample are injected into the ion trap. In this process, in order to increase the ion capture efficiency, an inert gas is introduced inside the ion trap in advance to make the injected ions collide with the inert gas to decrease the kinetic energy of the ions. This operation is called a cooling. After stably capturing the ions inside the ion trap in this manner, an ion or ions having a specific mass (or m/z, to be exact) are excited and ejected from the ion trap to be detected by a detector. A mass scan is performed by scanning the mass of the excited ions, and a mass spectrum can be created based on the detection signal obtained through the scanning.

However, in a general MALDI, one pulse of laser light irradiation often fails to generate a sufficient amount of ions, and in such a case, the signal-to-noise ratio (S/N) of the mass spectrum data obtained by one mass analysis as described above is low. Given this factor, the mass spectrum data with a high S/N is obtained by the following method. Ions are generated by a pulse of laser light irradiation; the ions are injected into the ion trap; the ions are captured and cooled; and the ions are separated with their mass and are detected. This process is repeated predetermined times (ten times for example), and the mass profiles obtained from each process are summed up on a computer.

In the above method, the more the process is repeated, the more the S/N of the mass spectrum data is improved. However, this causes a problem in that the measuring time to obtain a measurement result, i.e. a final mass spectrum, is elongated. For example, the apparatus that the inventors of the present invention used for the experiment requires a measuring time of about 1.1 seconds for one process. Therefore, about 11 seconds are required for a total of ten times, and about 33 seconds for a total of thirty times. Accordingly, the throughput of analysis decreases and the cost of analysis increases.

[Non-Patent Document 1] Furuhashi, Takeshita, Ogawa, Iwamoto, et al. "Digital Ion Trap Mass Spectrometer no Kaihatsu," *Shimadzu Review*: Shimadzu Hyoron Hensyubu, Mar. 31, 2006, vol. 62, nos. 3.4, pp. 141-151.

DISCLOSURE OF THE INVENTION

Problem to be Solved by the Invention

The present invention is accomplished to solve the aforementioned problem, and the main objective thereof is to provide an ion trap mass spectrometer that can shorten the measuring time for obtaining the measurement data with the quality (e.g. S/N) as high as before and contributes to the throughput enhancement of analysis and the cost reduction.

Means for Solving the Problem

In the series of processes of a mass analysis as previously described, the time required for the generation of ions and injection of the ions into the ion trap is short; compared to this, the time required for the cooling and the mass separation and detection is long. In particular, in performing a mass analysis (mass separation) in an ion trap, the time required for mass separation and detection is dominant in the measuring time. Based on this, the inventors of the present invention have conceived the idea of keeping the captured ions which have been injected into an ion trap, i.e. preventing the captured ions from dispersing as much as possible, and additionally injecting ions into the ion trap in order to increase the amount of ions to be mass separated and detected in one process. However, generally speaking, when a capture electric field is formed in an ion trap, the efficiency of injecting ions from outside is not always high. Given this factor, they have studied the methods for enhancing the ion injection efficiency in additionally injecting ions into the ion trap, and arrived at the invention of the present application.

To solve the previously described problem, the present invention provides an ion trap mass spectrometer having an ion source for supplying pulsed ions and an ion trap for capturing the ions by an electric field formed in the space surrounded by a plurality of electrodes, where ions supplied from the ion source are injected into the ion trap to be captured there and then mass analyzed by the ion trap or mass analyzed after the ions are ejected from the ion trap, the ion trap mass spectrometer including:

a) a voltage applier for applying a square wave voltage for capturing ions in the ion trap to at least one of the plurality of electrodes which compose the ion trap; and b) a controller for controlling the timing of supplying pulsed ions from the ion source, in synchronization with the phase or the level change of the square wave voltage, with the square wave voltage applied to the electrode or electrodes by the voltage applier, whereby, in addition to existing ions already captured in the ion trap, ions supplied from the ion source are injected into the ion trap.

The controller may control the timing of supplying the pulsed ions from the ion source in such a manner that the ions enter the ion trap when the square wave voltage applied to the electrode or electrodes by the voltage applier is at a specific timing in one cycle of the square wave voltage.

When the square wave voltage is applied to the electrode of the ion trap and thereby a capture electric field is formed in the ion trap, ions captured in the ion trap oscillate in accordance with the temporal movement the electric field. This oscillation is synchronized with every cycle of the square wave voltage, and the ions move in such a manner that they travel back and forth between the periphery and the center of the capture region in one cycle. That is, the state in which the ion cloud, which is a group of the ions, is expanded and the state in which the ion cloud contracts in the center alternately occur. When the ion cloud starts to expand, i.e. at the timing when the ions turn to the periphery from the center in the capture region, the electric field also acts on the ions entering the ion trap from outside to be repelled. On the other hand, at the timing when the ions turn to the center from the periphery in the capture region, the electric field also acts on ions entering the ion trap from outside to be taken in.

Therefore, considering such a behavior of ions, the controller may better control the timing of supplying the pulsed ions from the ion source in such a manner that the pulsed ions enter the ion trap at the timing when the ions in the captured state in the ion trap move toward the center from the expanded state to the periphery of the capture region.

When the waveform of the square wave voltage is considered, the relationship between the voltage and the behavior of ions depends on the polarity of the ions. Given this factor, in the case where cations are to be mass analyzed, the controller may control the timing of supplying the pulsed ions from the ion source in such a manner that the pulsed ions enter the ion trap during the low level period of the square wave voltage. More preferably, the controller may control the timing of supplying the ions in such a manner that the ions enter during the latter half period of the low level period of the square wave voltage. In the case where the square wave voltage is a symmetrical square wave voltage (i.e. duty ratio 0.5), the latter half period of the low level period of the square wave voltage falls in the range where the phase thereof is between $3\pi/2$ and $2\pi$.

In the case where anions are to be mass analyzed, the controller may control the timing of supplying the pulsed ions from the ion source in such a manner that the ions enter the ion trap during the high level period of the square wave voltage. More preferably, the controller may control the timing of supplying the ions in such a manner that the ions enter during the latter half period of the high level period of the square wave voltage. In the case where the square wave voltage is a symmetrical square wave voltage, the latter half period of the high level period of the square wave voltage falls in the range where the phase thereof is between $\pi/2$ and $\pi$.

The traveling time of an ion from the time point when the ion is generated in or the ion is ejected from the ion source until the ion reaches the inlet of the ion trap depends on the distance between the ion source and the ion trap, the intensity of the electric field between them, and other factors. In addition, since an ion with smaller mass travels faster in the same electric field, the traveling time of an ion depends also on the mass of the ion. Therefore, the controller may preferably control the ion source in such a manner that ions are supplied at the time point the traveling time before the preferable timing when the ions should reach the ion inlet of the ion trap. Therefore, it is preferable to control the ion source in such a manner that the timing of supplying the ions depends on the mass or mass range of the ions to be analyzed.

In addition to the case where the square wave voltage is a symmetrical square wave voltage as previously described, it can be an asymmetrical square wave voltage whose duty ratio is not 0.5. In the case of using such an asymmetrical square wave voltage, the value obtained by multiplying the voltage value of the positive voltage (high level) by the duration of the high level in a cycle and the value obtained by multiplying the voltage value of the negative voltage (low level) by the duration of the low level in a cycle may be equalized so that the mass range of ions stably captured becomes the same as the case where a symmetrical square wave voltage is used. Applying such an asymmetrical square wave voltage to the electrode or electrodes composing the ion trap and setting the timing for injecting ions into the ion trap within a relatively longer high level period or within a relatively longer low level period provide longer period of time during which ions can be efficiently injected into the ion trap.

As previously described, the timing at which an ion reaches the ion inlet of the ion trap varies according to the mass of the ion. Therefore, the longer the time period in which ions can be efficiently injected into the ion trap becomes, the larger the mass range of the ions that can be efficiently added to the ion trap.

As an embodiment of the ion trap mass spectrometer according to the present invention, the ion source may be a laser ion source for delivering a pulsed laser light to a sample to ionize the sample or components of the sample. For example, the ion source may be a matrix assisted laser desorption ionization source. This configuration facilitates the control of the controller: since the timing of the ion generation is determined by the irradiation timing of a laser light, the controller has only to control the generating position (or time point) of the control pulse for determining the irradiation timing of the laser light.

As another embodiment of the ion trap mass spectrometer according to the present invention, the ion source may include an ion holding unit for temporarily holding ions originating from a sample by the effect of an electric field or magnetic field, and compressing them, and then ejecting them in a pulsed fashion. As such an ion holding unit, the configuration disclosed in Japanese Patent No. 3386048 may be used. In this case, the source (ionization apparatus) of the ions to be held in the ion holding unit is not limited to a specific type, but may use a variety of atmospheric pressure ionization methods such as: an electrospray ionization (ESI) method; atmospheric pressure chemical ionization (APCI) method; and atmospheric pressure chemical photo ionization (APPI) method.

In the ion trap mass spectrometer according to the present invention, although the ion trap may be a linear ion trap, preferably it is a three-dimensional quadrupole ion trap having a ring electrode and a pair of end cap electrodes.

In addition, the ion trap mass spectrometer according to the present invention may further include an ion transport means of an electrostatic lens for transporting ions generated in the ion source to the ion trap. As the electrostatic lens, an Einzel lens (or unipotential lens) may be used for example. With the ion transport means of an electro static lens, the spread in the traveling time of ions until they reach the ion trap from the ion source due to variations in the mass of the ions becomes smaller. This enables the high-efficient injection of ions of accordingly large mass range into the ion trap.

The ion trap mass spectrometer according to the present invention may be constructed as: ions are first captured in the ion trap, then the frequency or the amplitude of the square wave voltage is changed to selectively eject ions having a specific mass from the ion trap, and the ejected ions are detected by a detector. In such a construction where ions are mass analyzed by the ion trap itself, because in general the time required for the mass separation and detection is considerably long compared to the time required for the ion generation and injection of ions into the ion trap, the present invention brings about a significant measuring time reducing effect.

The ion trap mass spectrometer according to the present invention may be constructed as: ions are first captured in the ion trap, then the captured ions are collectively ejected from the ion trap, and the ejected ions are injected into a mass analyzer to be mass analyzed and then detected by a detector. As the mass analyzer and detector, a time-of-flight mass spectrometer can be used for example.

The ion trap mass spectrometer according to the present invention may be constructed as: ions are captured in the ion trap, and then only ions having a specific mass are left as precursor ions in the ion trap, then the precursor ions are dissociated in the ion trap, and product ions generated thereby are mass analyzed by the ion trap or mass analyzed after the product ions are ejected from the ion trap. That is, this construction is an ion trap mass spectrometer for performing an MS/MS (or $MS^n$) analysis.

In such a construction of the ion trap mass spectrometer, selection of the precursor ions, dissociation of the precursor ions, and other operations are performed within the ion trap. Therefore, the time required for trapping ions in the ion trap is long, which tends to decrease the amount of target ions. Hence, it is particularly beneficial to increase the amount of target ions in advance of the selection of the precursor ion.

In the ion trap mass spectrometer according to the present invention, it is possible to use in such a manner that ions originating from the same sample are not additionally injected into the ion trap, but ions originating from different samples can be efficiently added to the ion trap. That is, ions originating from different samples can be mixed in the ion trap. By using this manner, a mass calibration by an internal reference method, which is efficient for increasing the precision of the mass data in a mass analysis, can be realized.

As an embodiment of the ion trap mass spectrometer according to the present invention for performing a mass calibration, the ion source may selectively supply ions originating from a sample to be analyzed (analysis sample) and ions originating from a sample for mass calibration (calibration sample), and the ion trap mass spectrometer may further include:

an analysis controller for supplying, first, either one of ions originating from the analysis sample and ions originating from the calibration sample from the ion source, and, while the ions are captured in the ion trap, for supplying the other one of ions originating from the analysis sample and ions originating from the calibration sample from the ion source and additionally injecting the ions into the ion trap, and then mass analyzing the mixture of the ions of the ions originating from the analysis sample and the ions originating from the calibration sample in the ion trap or after ejecting the mixture of the ions from the ion trap; and a data processor for performing a mass calibration by using the data of the ions originating from the calibration sample in the mass spectrum data obtained under the control of the analysis controller.

In the ion trap mass spectrometer according to this embodiment, ions originating from the analysis sample are first provided by the ion source, for example, and these ions are stably captured in the ion trap. Then, ions originating from the calibration sample are provided from the ion source, and while suppressing the loss of the ions previously captured as previously described, the ions originating from the calibration sample are additionally injected into the ion trap. Since the injection of the additional ions are efficiently performed, a sufficient amount of both ions originating from the analysis sample and ions originating from the calibration sample can be captured in the ion trap. In the case where the amount of ions in the ion injection is insufficient, ions can be additionally injected into the ion trap in the same manner, of course. By mass analyzing the ions mixed in the ion trap in the manner as just described, a mass spectrum in which the peaks of both ions appear can be obtained, and the data processor can perform an accurate mass calibration by the internal reference method.

In this case, the generation of ions originating from the analysis sample and the generation of ions originating from the calibration sample in the ion source can be performed at different timings. In other words, since they need not simultaneously generated, it is not necessary to use or ionize the mixed sample of the analysis sample and the calibration sample. In addition, the ionization conditions can be independently set.

In particular, the ion source may include for example:

a sample plate for holding the analysis sample and the calibration sample in different positions;

a laser light irradiator for delivering a pulsed laser light to a sample to ionize a component in the sample; and a moving means for moving the sample plate in such a manner as to selectively bring the analysis sample or the calibration sample to the position where the laser light is delivered by the laser light irradiator. This may include a matrix assisted laser desorption ionization source.

In an ordinary internal reference method, a mixed sample of an analysis sample and a calibration sample must be prepared. On the other hand, in the method according to the aforementioned embodiment, an analysis sample and a calibration sample can be independently prepared, and therefore the sample preparation workload is almost the same as the external standard method. Furthermore, since the optimum solvent and matrix can be selected in accordance with each sample, the sample preparation work can be facilitated, and the amount of ions generated from each sample can be maximized. Moreover, since the ionizations of the two samples are performed at different timings, it is also free from the problem of "ionization competition" in which ionization of a sample is suppressed when ionization of the other sample is dominant. This facilitates and simplifies the sample preparation, and furthermore, the ionization of each sample can be performed well, i.e. with high efficiency.

Since the ionization conditions other than the sample itself can be optimized for each sample, the laser light irradiator may change the intensity of the laser light between the case for ionizing the analysis sample and the case for ionizing the calibration sample.

The ion trap mass spectrometer according to the aforementioned embodiment can also be applied to an MS/MS analysis or $MS^n$ analysis in which ions generated from the analysis sample are not directly mass analyzed but such ions are dissociated one or plural times and the product ions generated thereby are mass analyzed.

That is, the ion trap mass spectrometer according to the aforementioned embodiment may further include:

an ion selector for applying a voltage to at least one of the plurality of electrodes which compose the ion trap in such a manner as to leave ions having a specific mass and remove other ions from the ion trap among ions captured in the ion trap; and a dissociation promoter for promoting the dissociation of ions captured in the ion trap, and the ions originating from the analysis sample are first captured in the ion trap, and the ions having the specific mass are left in the ion trap by the ion selector, then a dissociation of the left ions is promoted by the dissociation promoter, and after that, the ions originating from the calibration sample are additionally injected into the ion trap.

Alternatively, the ion trap mass spectrometer according to the aforementioned embodiment may further include an ion selector for applying a voltage to at least one of the plurality of electrodes which compose the ion trap in such a manner as to leave ions having a specific mass and remove other ions from the ion trap among ions captured in the ion trap, and, the ions originating from the analysis sample are first captured in the ion trap, and ions having the specific mass are left in the ion trap by the ion selector, and then ions originating from the calibration sample are additionally injected into the ion trap.

With such configurations, the mass of the ion peaks appearing on the mass spectrum obtained by an MS/MS analysis or MS″ analysis can be determined with the same high accuracy as with the mass calibration by the internal reference method.

Effects of the Invention

In the ion trap mass spectrometer according to the present invention, while ions are captured in the ion trap, ions newly generated can further be added and injected into the ion trap. Therefore, the mass separation and detection can be performed after the amount of the ions captured in the ion trap is increased, and the target ion can be detected with higher signal intensity than before. Hence, a mass spectrum with a sufficiently high S/N can be created without repeating the mass analysis and summing up the results, or with less number of repetitions of such mass analysis and summation. In addition, the measuring time required for the creation of a mass spectrum with a comparable S/N can be significantly reduced than before. Hence, the throughput of an analysis can be improved and simultaneously the cost required for an analysis of one sample can be reduced.

In the embodiment in which the ion trap mass spectrometer according to the present invention is used for a mass calibration, the mass accuracy as high as the internal reference method can be achieved, while avoiding the troubles of sample preparation for a general internal reference method and the problems in ion generation. In addition, a mass calibration substantially as accurate as the internal reference method can be performed not only in a general mass analysis, but also in an MS/MS analysis or MS″ analysis.

EXPLANATION OF NUMERALS

1 . . . Sample Plate
2 . . . Sample
3 . . . Laser Irradiator
4 . . . Mirror
13 . . . Aperture
14 . . . Einzel Lens
20 . . . Ion Trap
21 . . . Ring Electrode
22 . . . Entrance-Side End Cap Electrode
23 . . . Exit-Side End Cap Electrode
24 . . . Capture Region
25 . . . Ion Inlet
26 . . . Ion Outlet
27 . . . Entrance-Side Electric Field Correction Electrode
28 . . . Draw Electrode
29 . . . Cooling Gas Supplier
30 . . . Ion Detector
31 . . . Conversion Dynode
32 . . . Secondary Electron Multiplier
40 . . . Control Unit
41 . . . Laser Irradiation Timing Determiner
42 . . . Capture Voltage Generator
43 . . . Auxiliary Voltage Generator
44 . . . Data Processing Unit
51 . . . Sample Stage
52 . . . Sample Stage Drive
53 . . . CID Gas Supplier

BEST MODES FOR CARRYING OUT THE INVENTION

First Embodiment

Figure 1:
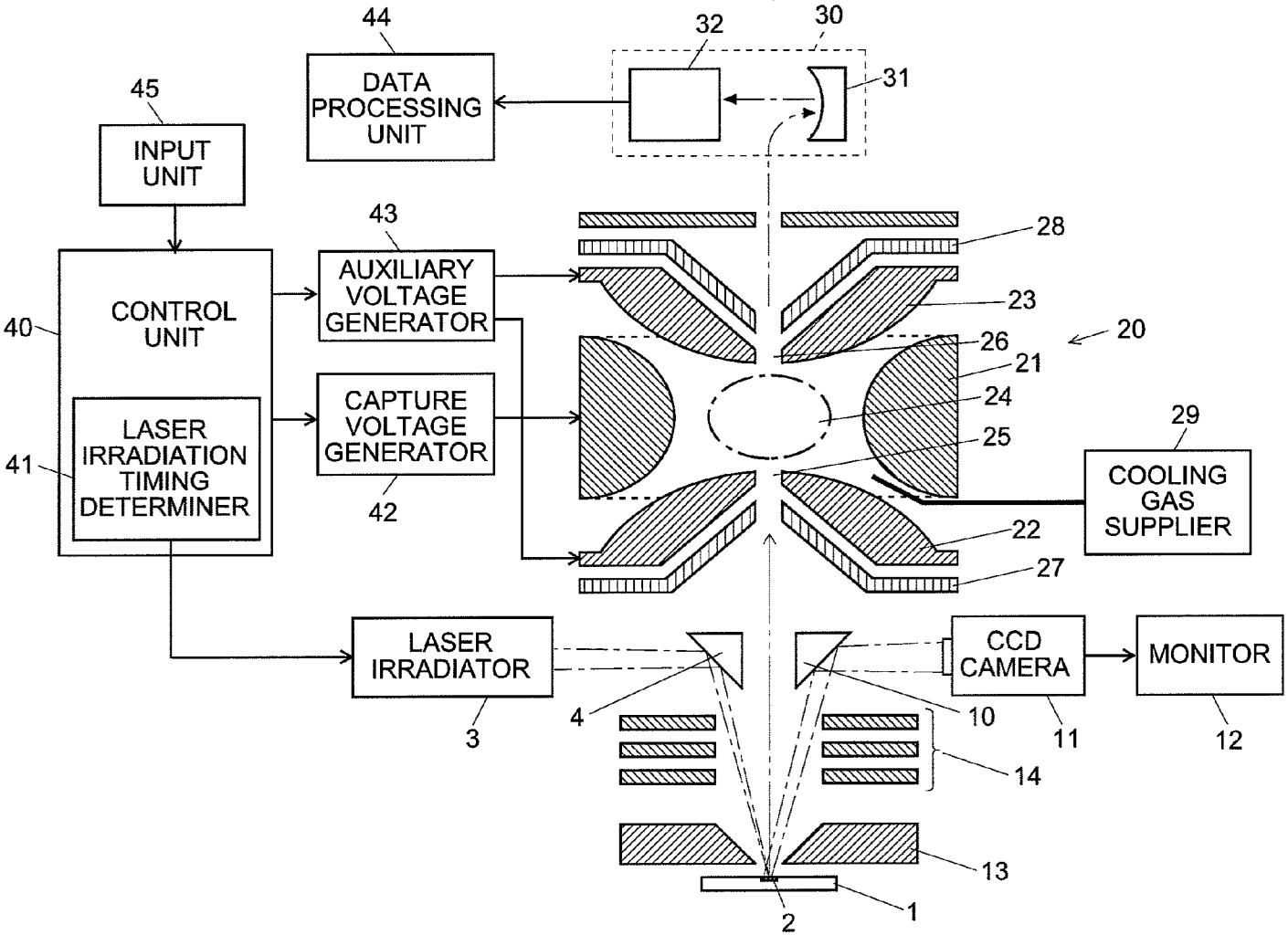
FIG. 1 is an entire configuration diagram of the MALDI-DIT-MS according to the first embodiment of the present invention.

The configuration and operation of the matrix assisted laser desorption ionization digital ion trap mass spectrometer (MALDI-DIT-MS) which is an embodiment (the first embodiment) of the present invention will be described in detail. FIG. 1 is an entire configuration diagram of the MALDI-DIT-MS according to this embodiment.

The ion trap 20 is the three-dimensional quadrupole ion trap which is composed of a circular ring electrode 21 and a pair of end cap electrodes 22 and 23 opposing each other (high and low in FIG. 1) with the ring electrode 21 therebetween. The inner surface of the ring electrode 21 has the shape of a hyperboloid-of-one-sheet-of-revolution, and that of the end cap electrodes 22 and 23 has the shape of a hyperboloid-of-two-sheets-of-revolution. The space surrounded by the ring electrode 21 and the end cap electrodes 22 and 23 forms a capture region 24. An ion inlet 25 is bored through the substantially center of the entrance-side end cap electrode 22. Outside of the ion inlet 25, an entrance-side electric field correction electrode 27 is placed for correcting the disorder of the electric field around the ion inlet 25. At substantially center of the exit-side end cap electrode 23, an ion inlet 26 is bored substantially in alignment with the ion inlet 25. Outside of the ion outlet 26, a draw electrode 28 is placed for drawing ions toward a detector 30, which will be described later. A cooling gas supplier 29 is provided for supplying a cooling gas (usually, inert gas) for cooling the ions in the ion trap 20 as will be described later.

A MALDI ion source (which corresponds to the ion source in the present invention) for generating ions includes: a laser irradiator 3 for emitting a laser light to be delivered to a sample 2 prepared on a sample plate 1; and a mirror 4 for reflecting and focusing the laser light on the sample 2. An observation image of the sample 2 is introduced to a CCD camera 11 via a mirror 10, and the sample observation image formed by the CCD camera 11 is displayed on the screen of a monitor 12. Between the sample plate 1 and the ion trap 20, an aperture 13 for shielding diffusing ions and an Einzel lens 14 as the ion transport optical system are placed. Various ion transport optical systems other than the Einzel lens 14 can be used. In particular, an electrostatic lens optical system can be used.

Outside the ion outlet 26 is placed the ion detector 30 which includes: a conversion dynode 31 for converting an injected ion into an electron; and a secondary electron multiplier 32 for multiplying and detecting the converted electrons. With this ion detector 30, both cations (positive ions) and anions (negative ions) can be detected. The detection signal by the ion detector 30 is provided to a data processing unit 44 in which the detection signal is converted into digital data and a data processing is performed on them.

A square wave voltage of a predetermined frequency is applied to the ring electrode 21 of the ion trap 20 from a capture voltage generator 42 (which corresponds to the voltage applier in the present invention), and a predetermined voltage (direct-current voltage or radio-frequency voltage) is applied to each of the pair of end cap electrodes 22 and 23 from an auxiliary voltage generator 43. In order to generate a square wave voltage as will be described later, the capture voltage generator 42 may include for example: a positive voltage generator for generating a predetermined positive voltage; a negative voltage generator for generating a predetermined negative voltage; and a switching unit for rapidly switching the positive voltage and negative voltage to generate a square wave voltage. A control unit 40 (which corresponds to the controller in the present invention) including a CPU and other components control the operation of the capture voltage generator 42 and the auxiliary voltage generator 43. A laser irradiation timing determiner 41 which is included as a function in the control unit 40 controls the operation of the laser irradiator 3 by generating a laser irradiation drive pulse signal at a timing corresponding to the phase or the level change (rise or decay) of the square wave voltage applied to the ring electrode 21 from the capture voltage generator 42.

Figure 2:
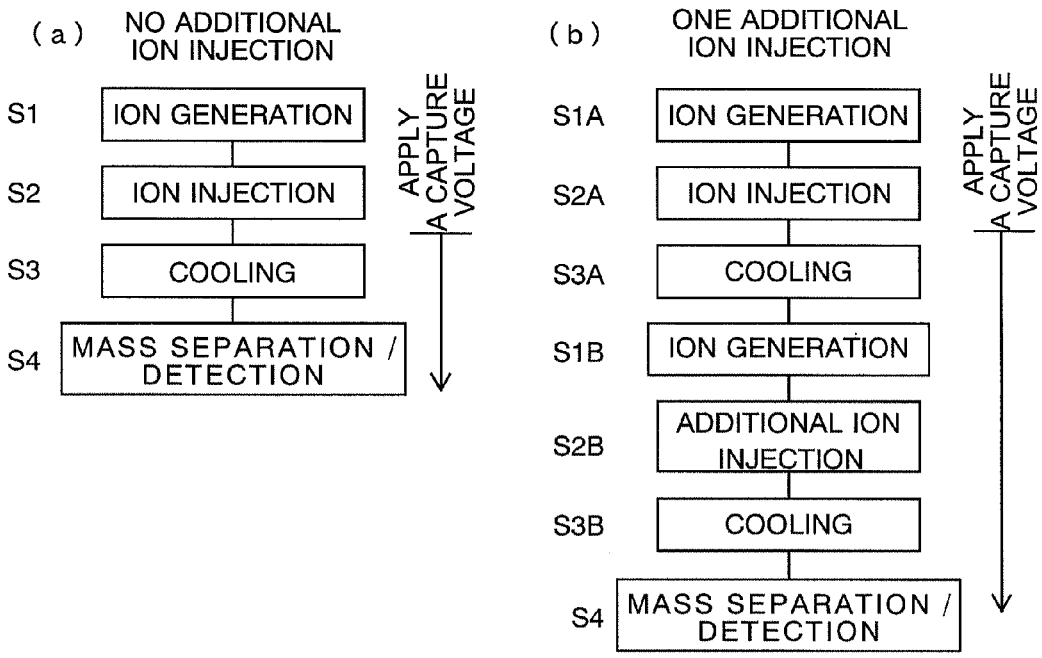
FIG. 2 is a flowchart illustrating the procedure of a series of processes performed for a mass analysis.
Figure 3:
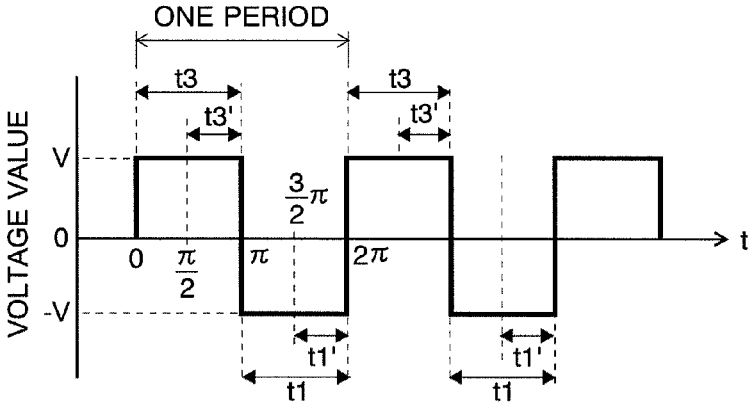
FIG. 3 is a diagram illustrating an example of the waveform of a capture voltage in the MALDI-DIT-MS of the first embodiment.
Figure 4:
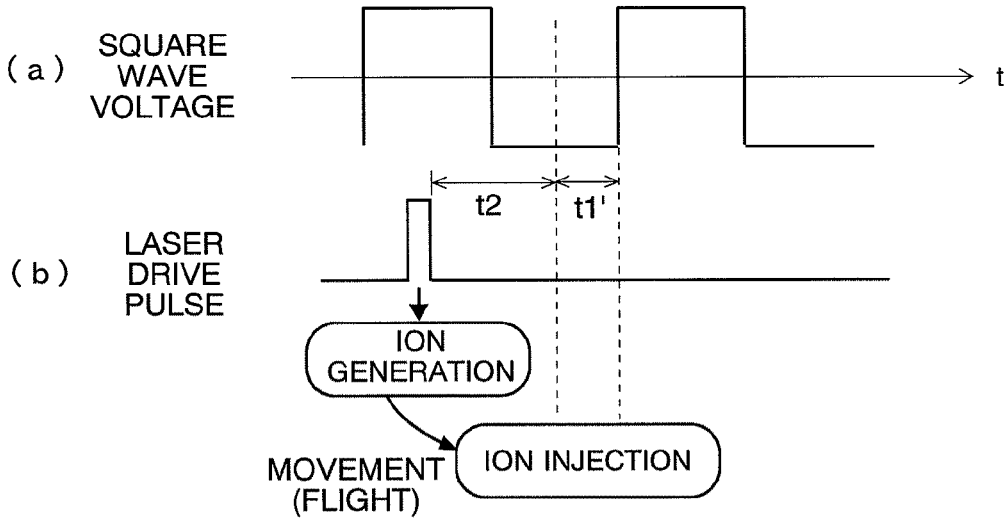
FIG. 4 is an explanation diagram of the operational timing in additionally injecting ions into the ion trap in the MALDI-DIT-MS of the first embodiment.
Figure 5:
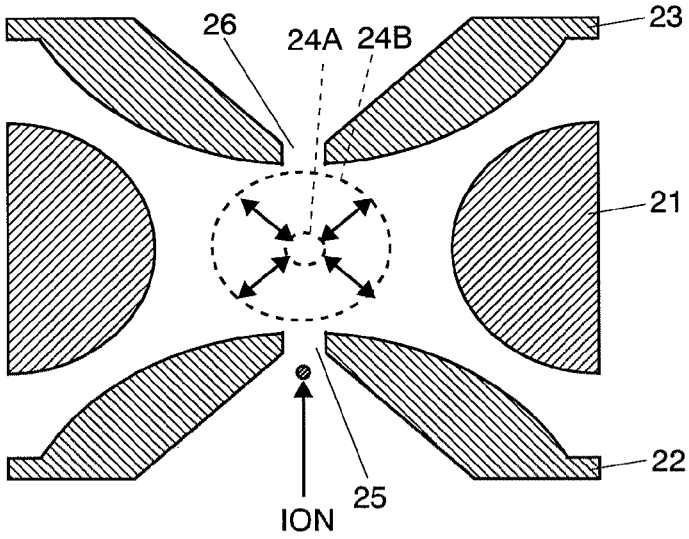
FIG. 5 is a diagram explaining the timing of additionally injecting ions into the ion trap in the MALDI-DIT-MS of the first embodiment.

Next, the procedure of a mass analysis will be described, centering on the specific operation of the MALDI-DIT-MS according to the present embodiment. FIG. 2 is a flowchart illustrating the procedure of a series of processes (operations) performed for the mass analysis. FIG. 3 is a diagram illustrating an example of the waveform of a capture voltage, FIG. 4 is an explanation diagram of the operational timing in additionally injecting ions into the ion trap, and FIG. 5 is a conceptual diagram for explaining the timing of additionally injecting ions into the ion trap.

FIG. 2(*a*) shows a procedure of the mass analysis, as in the conventional case, where an additional ion injection is not performed. Under the control of the control unit 40, a shot of laser light is emitted for a short time from the laser irradiator 3 to be delivered to the sample 2. By this laser light irradiation, the matrix in the sample 2 is quickly heated and vaporized with the target component. In this process, the target component is ionized (Step S1). The generated ions pass through the aperture 13, are sent toward the ion trap 20 while being converged by the electrostatic field formed by the Einzel lens 14, and injected into the ion trap 20 through the ion inlet 25 (Step S2). Since the irradiation time of the laser light is very short, the generation time of ions is also short. Therefore, the generated ions reach the ion inlet 25 in a packeted form.

When ions are injected in the aforementioned case, the capture voltage is not applied to the ring electrode 21, the entrance-side end cap electrode 22 is maintained at zero voltage, and an appropriate direct-current voltage having the same polarity as the ion to be analyzed is applied to the exit-side end cap electrode 23. With this configuration, when ions that have entered the ion trap 20 come near to the ion outlet 26, they are repelled back to the capture region 24 by the electric field formed by the direct-current voltage applied to the exit-side end cap electrode 23.

Before ions are injected in the aforementioned case, a cooling gas such as helium is introduced to the ion trap 20 from the cooling gas supplier 29. As previously described, immediately after the ions are injected into the ion trap 20, the capture voltage generator 42 starts, under the control of the control unit 40, to apply a predetermined square wave voltage as a capture voltage to the ring electrode 21. This square wave voltage has, as illustrated in FIG. 3 for example, a high level voltage value of V, low level voltage value of −V, frequency of f, and duty ratio of 0.5 (50%). Application of such a square wave voltage forms, inside the ion trap 20, a capture electric field for capturing ions while oscillating them. Although the injected ions initially have a relatively large kinetic energy, they collide with the cooling gas existing in the ion trap 20, their kinetic energy is gradually lost (i.e., a cooling is performed), and they become more likely to be captured by the capture electric field (Step S3).

After the cooling for an appropriate period (approximately 100 [ms], for example) to stably capture the ions in the capture region 24, a radio-frequency signal of a predetermined frequency is applied to the end cap electrodes 22 and 23 by the auxiliary voltage generator 43, with the square wave voltage applied to the ring electrode 21, and thereby ions having a specific mass are resonantly excited. As the radio-frequency signal, the frequency-divided signal of the square wave voltage applied to the ring electrode 21 can be used, for example. The excited ions having the specific mass are expelled from the ion outlet 26, and injected into the ion detector 30 to be detected. In this manner, the mass separation and detection of ions are performed (Step S4).

The frequency of the square wave voltage applied to the ring electrode 21 and the frequency of the radio-frequency signal applied to the end cap electrodes 22 and 23 are appropriately scanned so that the mass of ions expelled from the ion trap 20 through the ion outlet 26 is scanned. By sequentially detecting them, a mass spectrum can be created in the data processing unit 44.

Since, in the aforementioned procedure, ions generated from the sample 2 by a single shot of laser light irradiation are captured in the capture region 24 of the ion trap 20, and mass separated and detected, the amount of target ions is not always sufficient and the signal intensity may be low. In such a case, the MALDI-DIT-MS according to the present embodiment can perform a mass analysis with the procedure as illustrated in FIG. 2(*b*).

Steps S1A through S3A are the same as Steps S1 through S3 described before, by which ions are first captured in the capture region 24 in the ion trap 20. Next, with the ions captured in the capture region 24 of the ion trap 20, another shot of laser light is delivered again for a short time to the sample 2 to generate ions (Step S1B), and the generated ions are additionally injected into the ion trap 20 through the ion inlet 25 (Step S2B). Then, a cooling process is performed for the additionally injected ions (Step S3B), and the ions stably captured in the capture region 24 after the two ion injections are mass separated and detected (Step S4).

Although FIG. 2(*b*) illustrates an example of performing an additional injection of ions only once, the additional injection of ions into the ion trap 20 can be performed any number of desired times, by repeatedly performing Steps S1 through S3B.

In additionally injecting ions into the ion trap 20 as described above, it is required to keep applying the square wave voltage illustrated in FIG. 3 to the ring electrode 21 so that the ions already captured in the capture region 24 do not disperse. Therefore, ions are required to be injected into the ion trap 20 from the outside through the ion inlet 25 with the capture electric field formed in the ion trap 20, and the ions can be efficiently injected only at a predetermined timing in one period of the square wave voltage. The reason is as follows.

As illustrated in FIG. 5, the capture region 24 is formed by the capture electric field in the ion trap 20. In the capture region 24, ions are moving in accordance with the pulsation of the capture electric field (precisely, in accordance with the switching between the high level and low level of the square wave voltage). As individual ions, they move in such a manner as to travel back and forth between the peripheral part 24B and the center 24A of the capture region 24 as indicated by the arrows in FIG. 5. Viewed as a group, the group of ions forming an ion cloud pulsate between two states: the contracted state in which the cloud of ions compactly gather near the center 24A, and the expanded state in which the cloud of ions expand to the peripheral part 24B. If, for example, ions are tried to be injected into the ion trap 20 from the ion inlet 25 at the timing when the ion cloud is changing from the contracted state to the expanded state, the ions are not likely to be injected because the capture electric field acts in such a manner as to repel the incoming ions. On the other hand, if ions are injected at the timing when the ion cloud is changing from the expanded state to the contracted state, the ions are easily injected because the capture electric field acts in such a manner as to draw the incoming ions to the inside. Therefore, if ions in a packeted form arrive at the ion inlet 25 at such a timing, the ions are efficiently taken to the ion trap 20.

In the case where the target ion to be analyzed is a cation (positive ion), the preferable timing for the ion injection as previously described is the low level period of the square wave voltage as indicated by t1 in FIG. 3, and the particularly preferable timing is the latter half (t1' period in FIG. 3) of the low level period, i.e. the period of phase $(3/2)\pi$ through $2\pi$ in one cycle of a symmetric square wave voltage. However, it takes a certain amount of time (traveling time) for ions generated in the vicinity of the sample plate 1 to be transported by the Einzel lens 14 and arrive at the vicinity of the ion inlet 25. The traveling time depends on the distance between the sample plate 1 and the ion inlet 25, the configuration of the Einzel lens 14, the voltage applied thereto, and other factors. In addition, since ions having smaller mass reach the ion inlet 25 sooner even if the ions are generated exactly at the same time, the traveling time also depends on the mass of the ions to be analyzed.

Considering these factors, the traveling time should be obtained beforehand by a simulation computation or experiment, and memorized in a laser irradiation timing determiner 41. Since the traveling time depends on the mass of the ion to be targeted for the aforementioned reason, it is preferable to set that various data of traveling time can be read out depending on the mass or mass range. Then, the laser irradiation timing determiner 41 provides, as illustrated in FIG. 4, a laser drive pulse for generating ions at the time point the traveling time t2 before the starting point of the t1' period (or t1 period) in the square wave voltage. Accordingly, when the ions generated from the sample 2 by the laser light irradiation reach in the vicinity of the ion inlet 25, the square wave voltage applied to the ring electrode 21 is exactly at the t1' period (or t1 period). Therefore, the ions are efficiently injected into the ion trap 20 through the ion inlet 25.

In the case where the target ion to be analyzed is an anion (negative ion), the preferable timing for the ion injection as previously described is the high level period of the square wave voltage as indicated by t3 in FIG. 3, and the particularly preferable timing is the latter half (t3' period in FIG. 3) of the high level period, i.e. the period of phase $(1/2)\pi$ through $\pi$ of a cycle of a symmetric square wave voltage. Therefore, the control unit 40 has only to change the reference position in one period of the square wave voltage for determining the position (time point) of the generation of the laser drive pulse, in accordance with the polarity of the ion to be analyzed.

Figure 6:
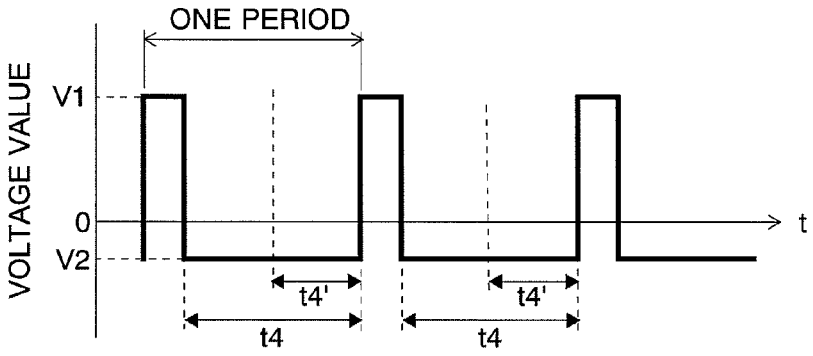
FIG. 6 is a diagram illustrating another example of the waveform of a capture voltage in the MALDI-DIT-MS of the first embodiment.

As previously described, even if all ions are generated on the sample plate 1 exactly at the same time, ions having smaller mass reach the ion inlet 25 first, and ions having relatively large mass reach late. Therefore, the mass width of the ions which can be injected into the ion trap 20 is determined by the duration of the t1' period and t3' period (or t1 period and t3 period) of the square wave voltage. Hence, in the case where the mass range of the target ion is large, it is preferable that the time width of the low level (in the case of a cation) or high level (in the case of an anion) of the square wave voltage may be widened. In the case where a cation is to be analyzed for example, the square wave voltage may be changed as illustrated in FIG. 6. That is, as the square wave voltage, an asymmetric square wave voltage whose duty ratio is not 0.5 is used to widen the time width of the low level.

In order to uniform the stabilization region of the capture electric field, i.e. in order not to change the mass range of the ions which can be captured, each parameter is required to set in such a manner that the frequency becomes the same as the symmetric square wave voltage, and the product of the voltage value and the time width in the high level period equals the product of the voltage value and the time width in the low level period in one period. To be more precise, the absolute values of the voltages of the high level and low level are not the same as illustrated in FIG. 3, but the absolute values of the voltages V1 and V2 of the high level and low level are different as illustrated in FIG. 6. The application of such an asymmetric square wave voltage as a capture voltage to the ring electrode 21 widens the time width, to t4 (or t4'), of the period in which cations can be efficiently taken to the ion trap 20 through the ion inlet 25. Hence, the mass width of the ions substantially added to the ion trap 20 can be widened.

Figure 7:
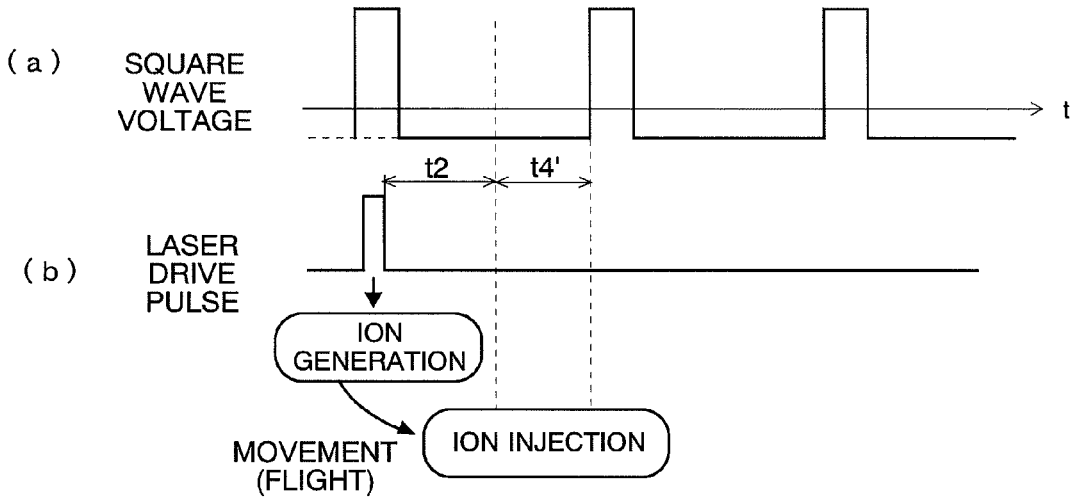
FIG. 7 is an explanation diagram for the operational timing in additionally injecting ions into the ion trap in the case where the capture voltage illustrated in FIG. 6 is used.

The actual timing of the laser light irradiation can be set, as illustrated in FIG. 7, at the reference point determined for the square wave voltage, e.g. the time point the traveling time t2 before the middle point of the low level period, as in the case where the capture voltage is a symmetric square wave voltage.

FIGS. 6 and 7 illustrate the case where the target ion is a cation. In the case where the target ion is an anion, it is evident that a voltage having the opposite polarity to this ion, i.e. an asymmetric square wave voltage having a duty ratio by which the high level period is longer than the low level period, can be applied as the capture voltage.

The results of a simulation computation performed for verifying the ion capture efficiency of the MALDI-DIT-MS according to the aforementioned embodiment will be described.

Figure 8:
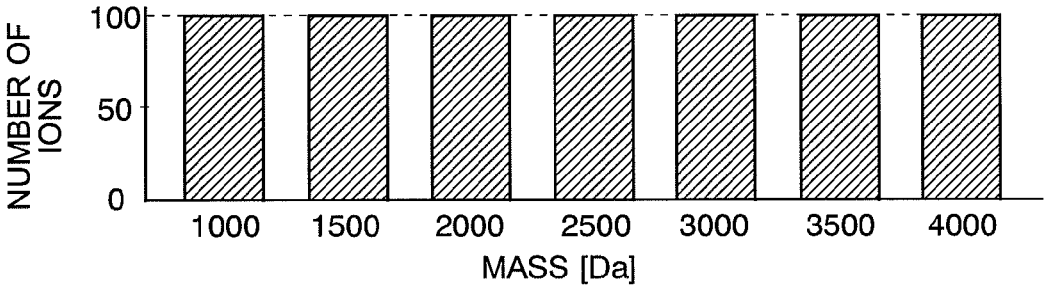
FIG. 8 is a diagram illustrating the results of a simulation for verifying the effect of an additional ion injection in the MALDI-DIT-MS of the first embodiment.
Figure 8:
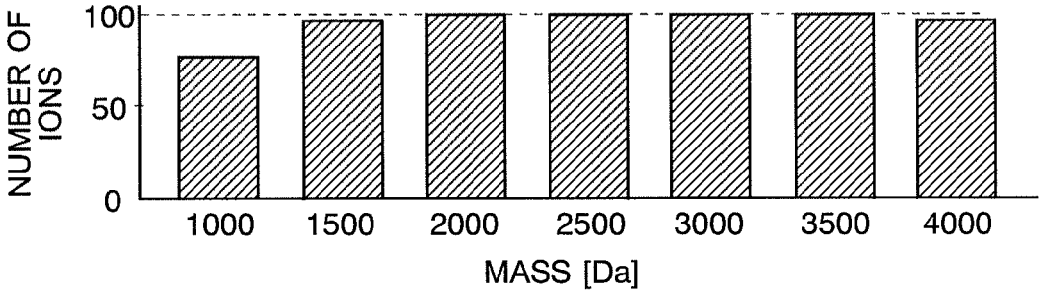
Figure 8:
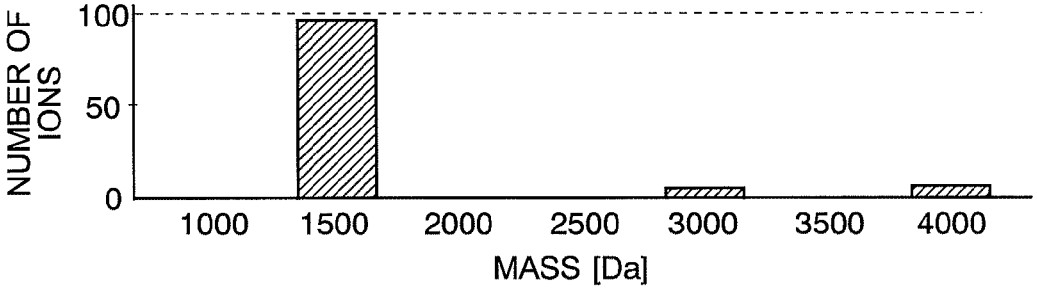

FIG. 8 illustrates the results of simulation in the case where a symmetrical square wave voltage of V=1000[V] and f=500 [kHz] is applied to the ring electrode. The horizontal axis represents the mass of ions, and the vertical axis represents the number of ions. As illustrated in FIG. 8(*a*), it was supposed that a set of 100 ions was simultaneously (at t=0 [μs]) generated at every 500 [Da] in the range of 1000 through 4000 [Da] in the ion source.

FIG. 8(*b*) illustrates the result of simulation calculating the number of ions remaining in the ion trap at the time point t=250 [μs], in the case where the application of square wave voltage to the ring electrode is started after almost all the ions generated as previously described have been injected into the ion trap. The particular conditions of the simulation were as follows: the application of the square wave voltage was started at t=13 [μs], the voltage applied to the entrance-side end cap electrode was zero, and the voltage applied to the exit-side end cap electrode was first set at 15[V] at t=0 [μs], and then changed from 15[V] to 0[V] at t=17 [μs]. In this case, it is understood that the amount of ions of mass of 1000 [Da] decreased to approximately 80%, while more than 95% of ions of other masses remained.

FIG. 8(*c*) illustrates the result of simulation calculating the number of ions remaining in the ion trap at the time point t=250 [μs], in the case where the square wave voltage has been applied to the ring electrode before ions are injected into the ion trap. The conditions of the voltages applied to the end cap electrodes were the same as in the case of FIG. 8(*b*). As is clear from this result, it is understood that ions having the mass of 1500 [Da] were captured with a high efficiency of more than 95%, while ions of other masses were hardly or not captured.

These results can be explained as follows. Ions simultaneously departed from the ion source having a variety of masses result in an expanded arrival time due to their masses when they reach the ion inlet. At the time when ions having the mass of 1500 [Da] arrived at the ion inlet, the t1 period (or t1' period) of the waveform of the square wave voltage, which is suitable for the ion injection, coincidentally lies there. In other words, it can be said that an additional injection into an ion trap can be very efficiently performed for ions having the mass of 1500 [Da] (and masses near that) with the conditions in this simulation computation. Therefore, it is also possible to efficiently add the ions having different masses to the ion trap, by shifting the timing of the ion generation or the timing of the laser light irradiation as previously described.

Figure 9:
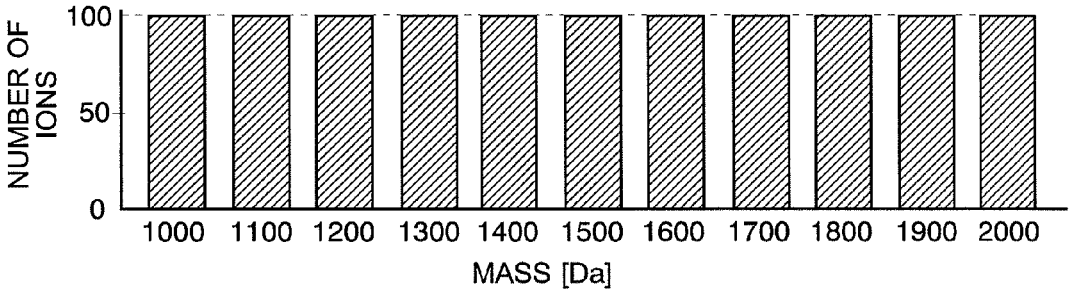
FIG. 9 is a diagram illustrating the results of a simulation for verifying the effect of an additional ion injection in the MALDI-DIT-MS of the first embodiment.
Figure 9:
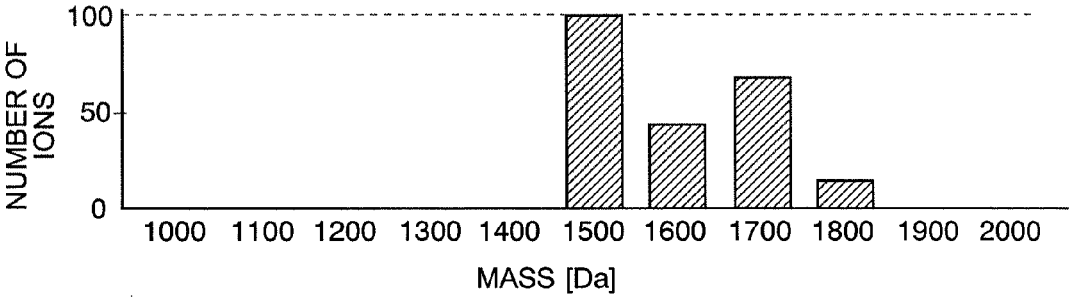
Figure 9:
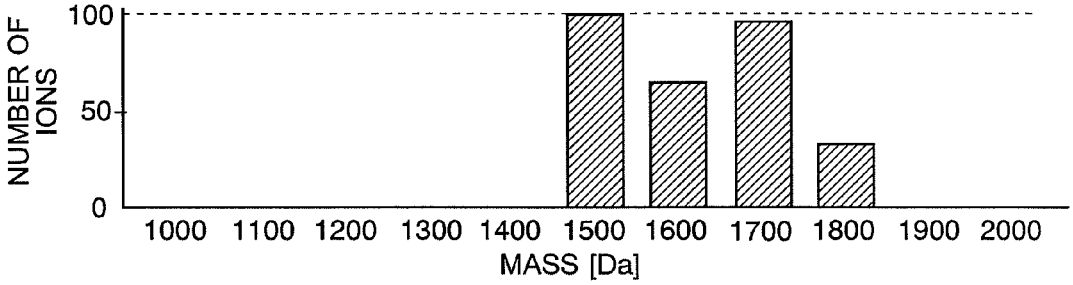

FIG. 9 illustrates the result of simulation in the case where the duty ratio of the square wave voltage is changed. As illustrated in FIG. 9(*a*), it was supposed that a set of 100 ions were simultaneously (at t=0 [μs]) generated at every 500 [Da] in the range of 1000 through 2000 [Da] in the ion source.

FIG. 9(*b*) illustrates the result of simulation calculating the number of ions remaining in the ion trap at the time point t=250 [μs] under the same conditions as FIG. 8(*c*). That is, the duty ratio of the square wave voltage was 0.5. In this case, ions in the mass range of 1500 through 1800 [Da] were captured, where more than 95% were captured at 1500 [Da], while ions of 1600, 1700 and 1800 [Da] were captured only with the efficiency of approximately 40%, 65%, and 13%, respectively.

FIG. 9(*c*) illustrates the result of simulation calculating the number of ions remaining in the ion trap at the time point t=250 [μs] in the case where the square wave voltage was set to be an asymmetric square wave voltage of f=500 [kHz], duty ratio of 0.25, V1=2000[V], and V2=−667[V]. In this case, the mass range of the captured ions was the same as before, falling between 1500 and 1800 [Da]. However, more than 95% were captured at 1500 [Da], and the capture efficiency of the ions of 1600, 1700 and 1800 [Da] were approximately 60%, 93%, and 30%, respectively, increasing 1.5 to 2 times compared to the cases where a symmetric square wave voltage was used. This signifies that the ions having a mass lager than 1500 [Da] became more easily accepted to the ion trap since the time width in which ions can be injected were widened as previously described.

As just described, the results of simulation computations also confirmed that by using an asymmetric square wave voltage as a capture voltage to be applied to the ring electrode, ions of large mass range can be efficiently added to the ion trap, compared to the case where a symmetric square wave voltage is used.

Adding ions to the ion trap as previously described can be performed not only once but can be repeated two and more times, and the amount of ions can be increased in accordance with the number of repetitions. The result of an experiment for verifying the effect according to the number of additional ion injections will be explained with reference to FIG. 10.

Figure 10:
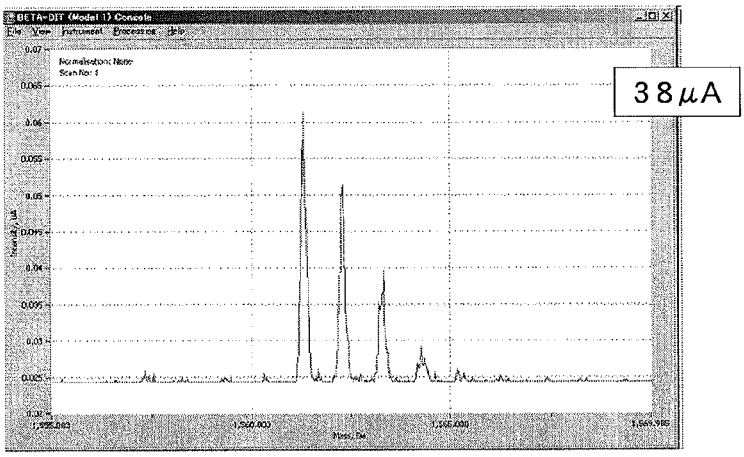
FIG. 10 is a diagram illustrating the result of an experiment for verifying the effect of an additional ion injection in the MALDI-DIT-MS of the first embodiment.
Figure 10:
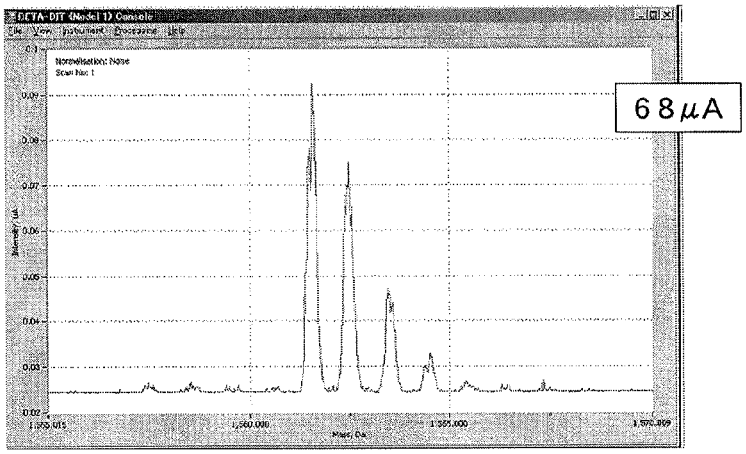
Figure 10:
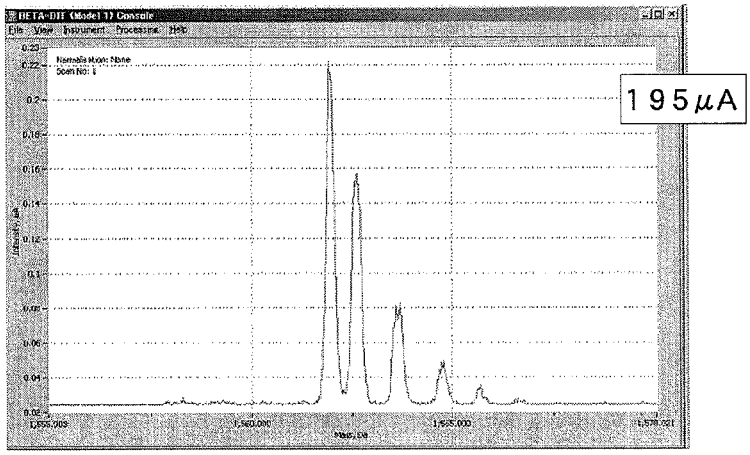

The sample was Glufibrinopeptide B (m/z: 1570), and the matrix was α-cyano-4-hydroxycinnamic acid (CHCA). In the present experiment, the following three sequences are prepared: no additional ion is injected (i.e. ions are injected only once) into the ion trap; ions are additionally injected twice. Each of the above three sequences was repeated ten times, so that the mass profiles detected each time were summed up for ten times to create an ultimate mass spectrum. The results are shown in FIG. 10, in which the signal intensities of the peak of the mass of 1570 are numerically shown. It was experimentally confirmed that the increase in the number of additional ion injections can increase the signal intensity and improves the S/N.

Further, by additionally injecting ions into the ion trap as previously described, the signal intensity can be increased while suppressing the elongation of the measuring time. That is, although the operation composed of: ion generation; ion injection; and then cooling is required for performing an additional ion injection as illustrated in FIG. 2, this series of operations is short compared to the time required for the sequentially performed mass analysis. Due to this, in the experiment the inventors of the present invention have carried out, the measuring time for the no additional ion injection, one additional ion injection; and two additional ion injections was respectively 11.1, 11.2, and 11.3 seconds. This shows that the effect of signal intensity increase as previously described can be achieved with little increase in the measuring time.

For comparison, the result obtained by performing a mass analysis after two additional ion injections is equivalent, simply speaking, to the case where a mass analysis without an additional ion injection is summed up three times. Hence, given that summation for the no additional ion injection is required to be performed thirty times to obtain the aforementioned result of FIG. 10(*c*), the measuring time in this case takes 33.3 seconds. Accordingly, two additional ion injections can achieve the effect of approximately 66% measuring time reduction.

Second Embodiment

Next, as another embodiment (the second embodiment) of the present invention, a MALDI-DIT-MS in which the function of the additional ion injection into the ion trap as previously described is used for a mass calibration will be described. Generally, in order to obtain data with high mass accuracy in a mass spectrometer, it is inevitable to perform a mass calibration using a standard sample whose mass is known. A mass calibration in a conventional MALDI-IT-MS is performed in the same manner as an apparatus without an ion trap such as a MALDI-TOFMS. Generally, there are two methods for performing a mass calibration in a MALDI-TOFMS: the external standard method and the internal standard method.

In performing a mass calibration by the external standard method, before a measurement of an analysis sample (analyte), an analysis operator applies a calibration sample (calibrant) including a compound whose mass is known at a different position on a sample plate from the analysis sample. Next, the measurement of the calibration sample is first performed, then the mass calibration of the apparatus is performed using this measurement result, and after that, the measurement of the analysis sample is performed. Alternatively, the measurement of the calibration sample may be performed after the measurement of the analysis sample, and after all the measurements, the mass calibration formula may be derived using the data obtained by the measurement of the calibration sample, and the mass calibration of the mass analysis data of the analysis sample may be performed as a post process using the formula. In addition, for the purpose of higher accuracy, a measurement of the calibration sample may be performed each time before and after the measurement of the analysis sample, and the mass calibration may be performed using the data obtained thereby. Such a series of measurements and computational processing for mass calibration is often performed on dedicated software supplied with the apparatus.

In performing a mass calibration by the internal standard method, an analysis operator prepares a sample in which the calibration sample is previously mixed to the analysis sample. Then, the measurement of the mixed sample is performed, and the mass calibration of the data is performed using the peak originating from the calibration sample on the obtained data (mass spectrum), and after the calibration, the mass of the peak originating from the analysis sample is read.

In terms of performing a calibration with high mass accuracy, the internal standard method is generally preferable to the external standard method. In order to perform the internal standard method, on the mass spectrum obtained by measuring the mixed sample, all the peaks originating from each sample must be included with sufficient intensity and resolution. In practice, however, the "ionization competition" frequently occurs in which ions of one sample become difficult to be generated when ions of the other sample are generated in large numbers, and therefore it is often difficult to obtain the appropriate mass spectrum as previously described. In order to prevent this happens, it is preferable to optimize the mixing ratio of the analysis sample and the calibration sample. However, since the optimal mixing ratio varies with the kinds of samples to be analyzed, such an optimization operation takes a lot of time. Hence, this method is impractical if the number of samples is large and high throughput is required.

If the optimum solvent and optimum matrix are different between the analysis sample and the calibration sample, preparation of the mixed sample is difficult by itself and the internal standard method cannot be employed. Consequently, the external standard method must be used, which decreases the accuracy of mass calibration.

In an MS/MS analysis or an $MS^n$ analysis using the MALDI-IT-MS, ions other than precursor ions are ejected from the ion trap in the course of selecting the precursor ions. Hence, the internal standard method cannot be employed. Therefore, the external standard method must be used also in this case, which decreases the accuracy of mass calibration.

Figure 11:
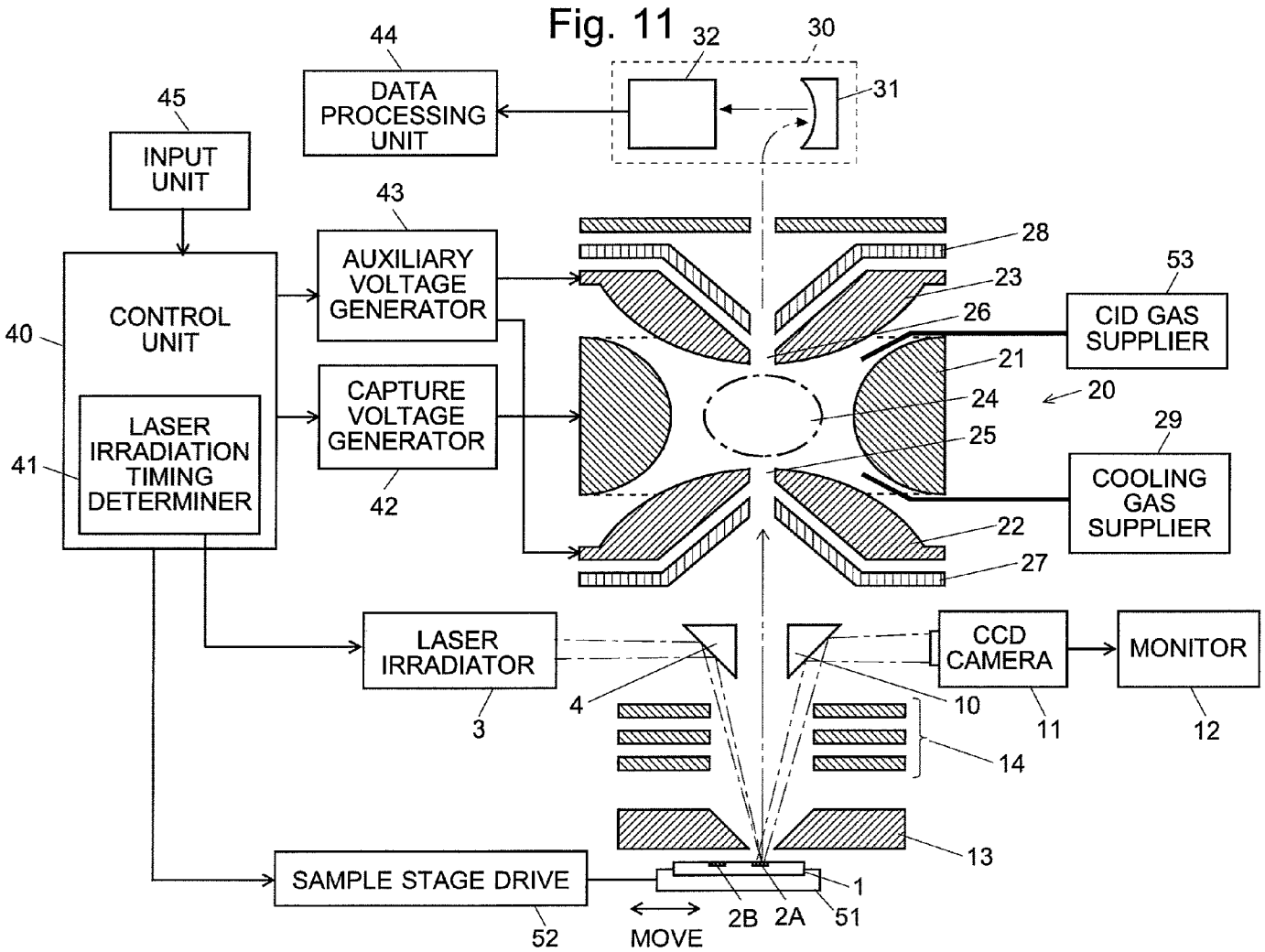
FIG. 11 is an entire configuration diagram of the MALDI-DIT-MS according to the second embodiment of the present invention.
Figure 12:
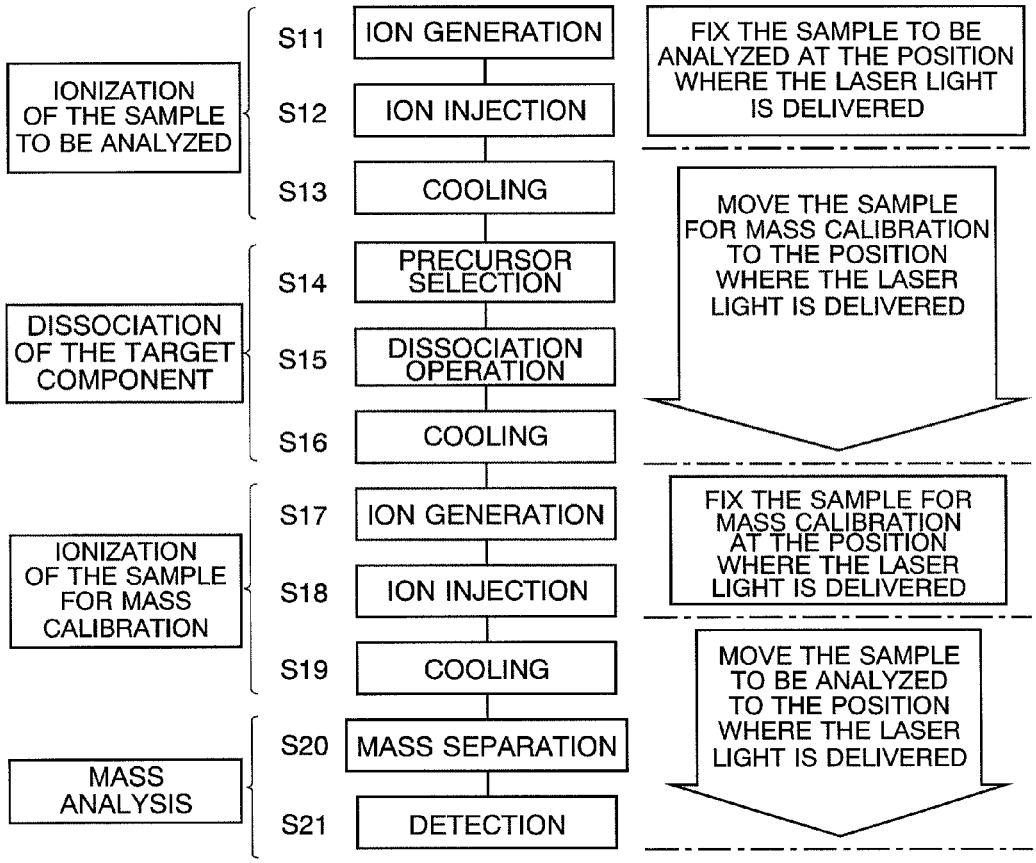
FIG. 12 is a flowchart illustrating the procedure of a typical mass analysis process performed in the MALDI-DIT-MS according to the second embodiment.

For these problems, by using the technique of the additional ion injection as previously described, it is possible to realize a mass calibration in accordance with the internal standard method without preparing a mixture of the analysis sample and the calibration sample. FIG. 11 is an entire configuration diagram of the MALDI-DIT-MS according to this second embodiment, and FIG. 12 is a flowchart illustrating the procedure of a typical mass analysis process performed in the MALDI-DIT-MS according to the second embodiment. In FIG. 11, the same components as the MALDI-DIT-MS in the first embodiment as illustrated in FIG. 1 are indicated with the same numerals and the explanations are omitted.

In the MALDI-DIT-MS of the second embodiment, an analysis sample 2A and a calibration sample 2B are prepared at different positions on the sample plate 1. It is preferable that their positions may be as close as possible. A sample stage 51 for holding the sample plate 1 is movable by a sample stage drive 52 including a drive source such as a motor, and thereby the analysis sample 2A and the calibration sample 2B are selectively brought to the position where a laser light is delivered. Since the analysis sample 2A and the calibration sample 2B can be independently prepared, a suitable solvent and matrix can be chosen for each of them, and the preparation can be performed in exactly the same manner as in the case of the mass calibration by the external standard method. A CID gas supplier 53 is for introducing a CID gas such as argon in order to dissociate ions by the collision induced dissociation (CID) in the ion trap 20.

When an analysis is started, the control unit 40 locates, by the sample stage drive 52, the analysis sample 2A at the position where a laser is delivered, and a laser light is shot for a short time from the laser irradiator 3 to the analysis sample 2A. The intensity of the laser in this process is previously set to satisfy the conditions on which the generation efficiency of the ions of the target component of the analysis sample 2A. The irradiation of the laser light ionizes the target component in the analysis sample 2A (Step S11). Immediately before the irradiation of the laser light, a cooling gas is introduced inside the ion trap 20 from the cooling gas supplier 29. The ions generated with the irradiation of the laser light are injected into the ion trap 20 through the aperture 13, Einzel lens 14, and via the ion inlet 25 (Step S12). While these ions are injected, a capture voltage is not applied to the ring electrode 21. An appropriate direct-current voltage having the opposite polarity to the analysis ions is applied to the entrance-side end cap electrode 22 and an appropriate direct-current voltage having the same polarity as the analysis ions is applied to the exit-side end cap electrode 23.

Immediately after the ions are injected into the ion trap 20, the auxiliary voltage generator 43 applies a direct-current voltage having the same polarity as the analysis ions to the entrance-side end cap electrode 22 to trap the injected ions in the ion trap 20. Slightly after this, the auxiliary voltage generator 42 starts to apply a predetermined square wave voltage as the capture voltage to the ring electrode 21. This makes the ions trapped in the ion trap 20 move on the stable orbit by the capture electric field. The captured ions lose their kinetic energy by colliding with the cooling gas which has been previously injected into the ion trap 20, their orbit becomes smaller, and they are assuredly captured (Step S13).

Next, in order to selectively leave the ions having a specific mass as the precursor ion among a variety of ions originating from the analysis sample 2A captured in the ion trap 20, the other ions are expelled from the ion trap 20 (Step S14). In order to perform such a selection, a conventionally-known method, such as the method described in U.S. Pat. No. 6,900,433, the method described in Japanese Unexamined Patent Application Publication No. 2003-16991 or other method can be used.

To give an example, when radio-frequency voltages having opposite polarities are applied between the pair of end cap electrodes 22 and 23, ions having the natural frequency (eigenfrequency) corresponding to the frequency of the radio-frequency voltage resonate and oscillate. The amplitude of their resonant vibration gradually increases, and soon such ions fly out of the ion trap 20 or collide with the inner surface of the electrode to be eliminated. The mass of the resonant-oscillating ions has a predetermined relationship with the natural frequency. Therefore, in order to eliminate unnecessary ions having a predetermined mass, it is only necessary to apply a radio-frequency voltage having a frequency in correspondence to the mass of the ions to the end cap electrodes 22 and 23.

Alternatively, a wideband AC voltage having a frequency spectrum which has a notch at the frequency corresponding to the mass of the ions to be left may be applied to the end cap electrodes 22 and 23. Then, only the ions having the mass corresponding to the notch frequency do not resonantly oscillate, and remain in the ion trap 20, and the other ions are eliminated from the ion trap 20. Such a wideband voltage having a notch as previously described can be generated by the methods such as: synthesizing a large number of sinusoidal voltages having different frequencies, and forming a notch in a white noise.

After selecting the precursor ions, a collision-induced dissociation (CID) gas such as argon is provided to the ion trap 20 from the CID gas supplier 53 in order to dissociate the precursor ions left in the ion trap 20, and immediately after this, the auxiliary voltage generator 43 applies an excitation voltage, to the end cap electrodes 22 and 23, of a frequency which is the same as the secular frequency determined by the mass of the precursor ion. This oscillates the precursor ions and they collide with the CID gas to generate a variety of product ions (Step S15).

After the dissociation operation, in order to shrink and stabilize the orbit of the generated product ions, a cooling gas is injected into the ion trap 20 from the cooling gas supplier 29 to cool the product ions (Step S16).

When the ion generation and injection by the laser light irradiation are finished, the control unit 40 moves the sample stage 51 to locate the calibration sample 2B at the position where the laser is delivered. At the latest, by the time point when the cooling of Step S16 finishes, the calibration sample 2B is set at the position where the laser is delivered.

After the cooling, under the control of the control unit 40, the laser irradiator 3 emits a laser light for a short time to deliver it to the calibration sample 2B. This ionizes the component in the calibration sample 2B (Step S17). In the case where a cation is to be analyzed, as previously described and illustrated in FIG. 4, the laser irradiation timing determiner 41 provides a laser drive pulse to the laser irradiator 3 so that ions are generated at the time point the traveling time t2 of ion before the time point when the t1' period starts in the square wave voltage applied to the ring electrode 21. This traveling time t2 is determined in correspondence to the mass of the ions originating from the calibration sample 2B which is to be analyzed. In the case where an anion is analyzed, the laser irradiation timing determiner 41 provides a laser drive pulse to the laser irradiator 3 so that ions are generated at the time point the traveling time t2 of ion before the time point when the t3' period starts in the square wave voltage applied to the ring electrode 21. Immediately before the irradiation of the laser light, a cooling gas is introduced inside the ion trap 20 from the cooling gas supplier 29.

By setting the timing of the laser irradiation to fall in a specific position in phase of the square wave voltage applied to the ring electrode 21 as previously described, when a cation generated from the calibration sample 2B by the laser light irradiation reaches in the vicinity of the ion inlet 25, the square wave voltage is in the t1' period, i.e. in the period of phase $(3/2)\pi$ through $2\pi$ of a cycle in the case of a symmetric square wave voltage. In the case of an anion, when it reaches in the vicinity of the ion inlet 25, the square wave voltage is in the t3' period, i.e. during the period of phase $(1/2)\pi$ through $\pi$ of a cycle in the case of a symmetric square wave voltage. Consequently, ions injected into the ion trap 20 through the ion inlet 25 are not repelled but well taken in, and added to the product ions originating from the sample 2A which have been already held in the ion trap 20 (Step S18).

After that, in order to shrink and stabilize the orbit of the ions originating from the calibration sample 2B, a cooling gas is introduced to the ion trap 20 from the cooling gas supplier 29 to cool the additionally injected ions (Step S19). As a result, in the ion trap 20, a variety of product ions generated from the precursor ion having a specific mass among ions originating from the analysis sample 2A, and ions originating from the calibration sample 2B are stably held in a mixed state.

After the cooling for an appropriate time, as in Step S4 in the first embodiment, the frequency of the square wave voltage applied to the ring electrode 21 and the frequency of the radio-frequency signal applied to the end cap electrodes 22 and 23 are appropriately scanned so that the masses of ions to be resonantly-excited are scanned. The ions ejected with this scanning from the ion trap 20 are sequentially detected in the ion detector 30 (Steps S20 and S21). Accordingly, a mass spectrum of a predetermined mass range can be created in the data processing unit 44. On the mass spectrum, the peaks of the product ions and other ions originating from the analysis sample 2A and the peaks of the ions originating from the calibration sample 2B appear. Since the mass of the ions originating from the calibration sample 2B is known, the data processing unit 44 extracts the peaks originating from the calibration sample 2B among the peaks appearing on the mass spectrum and performs a mass calibration using the ion peaks. After the calibration, the mass of the peaks of a variety of ions to be targeted is read and processed, e.g. identified.

That is, ions originating from the analysis sample 2A and ions originating from the calibration sample 2B that are mixed in the ion trap 20 are simultaneously measured, then a mass calibration is performed using the result of the latter measurement, and the result of the former measurement is accurately obtained. In this respect, this is a mass calibration itself by the internal standard method, and a high mass accuracy can be achieved. On the other hand, the sample analysis 2A and the calibration sample 2B are not required to be mixed beforehand, and each of them can be individually prepared using a different solvent and different matrix (the same solvent and matrix may be used, of course). In this respect alone, the same simplicity as the external standard method is achieved. In other words, it can be said that the mass calibration realized with this apparatus according to the second embodiment combines the high mass accuracy by the internal standard method and the easiness of the sample preparations in the external standard method.

In the aforementioned explanation, the voltage applied to the ring electrode 21 was a symmetric square wave voltage. However, it is evident that the voltage can be an asymmetric square wave voltage as described in the explanation for the first embodiment.

In the aforementioned explanation, the analysis sample 2A and the calibration sample 2B are each ionized once and injected into the ion trap 20. However, ions originating from each sample may be additionally injected into the ion trap 20 to increase the amount of ions to be mass analyzed.

In the case where the calibration sample 2B contains one kind of sample component, or where although it contains plural kinds of sample components, only one kind of component among them is needed to be used for the mass calibration, the traveling time t2 can be obtained in correspondence to the mass of the ions generated from the sample component as previously described. Even in the case where plural kinds of components are needed to be used for the mass calibration, if the masses of the ions originating from each component are close, the traveling time t2 corresponding to the mass of one ion among them or corresponding to their average mass may be obtained to determine the timing of the laser light irradiation. However, in the case where plural kinds of components are needed to be used for the mass calibration and where the masses of the ions originating from each component are apart, it is difficult to inject each kind of ions generated from the calibration sample 2B into the ion trap 20 by one laser light irradiation, in a specific period of phase of a square wave voltage. This is because the period corresponding to ¼ cycle of a square wave voltage during which ions can be efficiently injected is only 400 to 500 [ns], and the difference of the traveling times t2 corresponding to the ions whose masses are apart exceed this. Given this factor, it is preferable that the optimum timing of laser light irradiation may be obtained from each mass of plural kinds of ions, and the laser light irradiations may be sequentially performed based on the optimum laser light irradiation timing, with each irradiation delayed for equal to or more than one cycle. By doing so, each of the ions originating from the calibration samples 2B having different masses is efficiently injected into the ion trap 20 in series.

In the case where ions originating from the analysis sample 2A are needed to be directly observed, the operations of Steps S14 through S16 in the flowchart illustrated in FIG. 12 may be omitted. In this case, the procedures may be interchanged in such a manner that the ionization and ion injection of the calibration sample 2B may be performed first, and then the ionization and additional ion injection of the analysis sample 2A may be performed. Alternatively, the precursor selection and dissociation process may be repeated plural times rather than performing only once the dissociation of the ions originating from the analysis sample 2A.

The operation of selectively leaving ions having a specific mass among the ions originating from the analysis sample 2A (which is the same operation as the precursor selection of Step S14) may be performed. Subsequently, without dissociating them, the ionization and additional ion injection of the calibration sample 2B may be performed.

Generally, since the efficiency of ion generation differs depending on the kind of sample, it is preferable that the intensity of the laser light irradiated for the ionization of the analysis sample 2A and the intensity of the laser light irradiated for the ionization of the calibration sample 2B may be independently set. The optimum laser light intensity can be determined by a preliminary experiment using actual samples.

It should be noted that the embodiments described thus far are merely an example of the present invention, and it is evident that any modification, addition, or adjustment made within the sprit of the present invention is also covered by the present patent application.

The invention claimed is:

1. An ion trap mass spectrometer having an ion source for supplying pulsed ions and an ion trap for capturing the ions by an electric field formed in a space surrounded by a plurality of electrodes, where ions supplied from the ion source are injected into the ion trap to be captured there and then mass analyzed by the ion trap or mass analyzed after the ions are ejected from the ion trap, the ion trap mass spectrometer comprising:

a) a voltage applier for applying a square wave voltage for capturing the ion in the ion trap to at least one of the plurality of electrodes which compose the ion trap; and b) a controller for controlling a timing of supplying pulsed ions from the ion source, in synchronization with a phase or a level change of the square wave voltage, with the square wave voltage applied to the electrode or electrodes by the voltage applier, in order that in addition to existing the ions already captured in the ion trap, ions supplied from the ion source are injected into the ion trap, wherein the controller controls, in a case where a cation is to be mass analyzed, the timing of supplying the pulsed ions from the ion source in such a manner that the pulsed ions enter the ion trap in a low level period of the square wave voltage, and in a case where an anion is to be mass analyzed, the timing of supplying the pulsed ions from the ion source in such a manner that the pulsed ions enter the ion trap in a high level period of the square wave voltage, in order that the pulsed ions enter the ion trap at a timing when the ions in a captured state in the ion trap move toward a center from an expanded state in a periphery of a capture region.

2. The ion trap mass spectrometer according to claim 1, wherein the square wave voltage is a symmetrical square wave voltage.

3. The ion trap mass spectrometer according to claim 1, wherein the square wave voltage is an asymmetrical square wave voltage and the timing for injecting ions into the ion trap is set to be within a relatively longer high level period or within a relatively longer low level period.

4. The ion trap mass spectrometer according to claim 1, wherein the ion source is a laser ion source for delivering a pulsed laser light to a sample to ionize the sample or a component in the sample.

5. The ion trap mass spectrometer according to claim 4, wherein the ion source is a matrix assisted laser desorption ionization source.

6. The ion trap mass spectrometer according to claim 1, wherein the ion trap is a three-dimensional quadrupole ion trap having a ring electrode and a pair of end cap electrodes.

7. The ion trap mass spectrometer according to claim 1, further comprising an ion transport means of an electrostatic lens for transporting an ion supplied from the ion source to the ion trap.

8. The ion trap mass spectrometer according to claim 7, wherein the electrostatic lens is an Einzel lens (or unipotential lens).

9. The ion trap mass spectrometer according to claim 1, wherein ions are captured in the ion trap, then a frequency or an amplitude of the square wave voltage is changed to selectively eject ions having a specific mass from the ion trap, and the ejected ions are detected by a detector.

10. The ion trap mass spectrometer according to claim 1, wherein ions are captured in the ion trap, then the captured ions are collectively ejected from the ion trap, and the ejected ions are injected into a mass analyzer to be mass analyzed and then detected by a detector.

11. The ion trap mass spectrometer according to claim 1, wherein ions are captured in the ion trap, and then only ions having a specific mass is left as precursor ions in the ion trap, then the precursor ions are dissociated in the ion trap, and a product ions generated thereby is mass analyzed by the ion trap or mass analyzed after the product ions are ejected from the ion trap.

12. The ion trap mass spectrometer according to claim 1, wherein the ion source selectively supplies ions originating from an analysis sample and ions originating from a calibration sample, and the ion trap mass spectrometer further comprises:

an analysis controller for supplying either one of ions originating from the analysis sample and ions originating from the calibration sample from the ion source, and, while the ions are captured in the ion trap, for supplying other one of the ions originating from the analysis sample and the ions originating from the calibration sample from the ion source and additionally injecting the ions into the ion trap, and then mass analyzing mixture of the ions originating from the analysis sample and the ions originating from the calibration sample in the ion trap or after ejecting the mixture of the ions from the ion trap; and a data processor for performing a mass calibration by using data of the ion originating from the calibration sample in mass spectrum data obtained under a control of the analysis controller.

13. The ion trap mass spectrometer according to claim 12, wherein the ion source includes:

a sample plate for holding the analysis sample and the calibration sample in different positions;

a laser light irradiator for delivering a pulsed laser light to a sample to ionize a component in the sample; and a moving means for moving the sample plate in such a manner as to selectively bring the analysis sample and the calibration sample at a position where the laser light is delivered by the laser light irradiator.

14. The ion trap mass spectrometer according to claim 13, wherein the ion source is a matrix assisted laser desorption ionization source.

15. The ion trap mass spectrometer according to claim 14, wherein the laser light irradiator changes an intensity of the laser light between a case for ionizing the analysis sample and a case for ionizing the calibration sample.

16. The ion trap mass spectrometer according to claim 12, further comprising:

an ion selector for applying a voltage to at least one of the plurality of electrodes which compose the ion trap in such a manner as to leave ions having a specific mass and remove other ions from the ion trap among ions captured in the ion trap; and a dissociation promoter for promoting a dissociation of ions captured in the ion trap, wherein:

the ions originating from the analysis sample are first captured in the ion trap, and the ions having the specific mass are left in the ion trap by the ion selector, then a dissociation of the left ions is promoted by the dissociation promoter, and after that, the ions originating from the calibration sample are additionally injected into the ion trap.

17. The ion trap mass spectrometer according to claim 12, further comprising an ion selector for applying a voltage to at least one of the plurality of electrodes which compose the ion trap in such a manner as to leave ions having a specific mass and remove other ions from the ion trap among ions captured in the ion trap, wherein:

the ions originating from the analysis sample are first captured in the ion trap, and the ions having the specific mass are left in the ion trap by the ion selector, and then the ions originating from the calibration sample are additionally injected into the ion trap.

18. The ion trap mass spectrometer according to claim 1, wherein the controller changes the timing of supplying the pulsed ions from the ion source in correspondence to a mass or a mass range of ions to be analyzed.

* * * * *